US008596348B2

(12) United States Patent
Brookbank

(10) Patent No.: US 8,596,348 B2
(45) Date of Patent: Dec. 3, 2013

(54) DOWNHOLE CONNECTOR MAINTENANCE TOOL

(75) Inventor: Earl B. Brookbank, Claremore, OK (US)

(73) Assignee: Baker Hughes Incorporated, Houston, TX (US)

( * ) Notice: Subject to any disclaimer, the term of this patent is extended or adjusted under 35 U.S.C. 154(b) by 1155 days.

(21) Appl. No.: 12/535,858

(22) Filed: Aug. 5, 2009

(65) Prior Publication Data

US 2011/0030972 A1 Feb. 10, 2011

(51) Int. Cl.
*E21B 43/00* (2006.01)

(52) U.S. Cl.
USPC ..... 166/170; 166/65.1; 166/174; 166/377; 166/378

(58) Field of Classification Search
USPC ..... 166/377, 378, 65.1, 170, 174, 175
See application file for complete search history.

(56) References Cited

U.S. PATENT DOCUMENTS

| | | | | |
|---|---|---|---|---|
| 1,801,731 | A | 4/1931 | Farrington | |
| 4,589,492 | A | 5/1986 | Greiner et al. | |
| 4,997,384 | A | 3/1991 | Godfrey et al. | |
| 5,389,003 | A | 2/1995 | Van Steenwyk et al. | |
| 6,154,953 | A | 12/2000 | MacKinnon | |
| 6,398,583 | B1 | 6/2002 | Zehren | |
| 6,415,869 | B1 | 7/2002 | Smith | |
| 7,074,064 | B2 * | 7/2006 | Wallace | 439/190 |
| 7,291,028 | B2 | 11/2007 | Hall et al. | |
| 7,404,725 | B2 | 7/2008 | Hall et al. | |
| 7,462,051 | B2 | 12/2008 | Hall et al. | |
| 2002/0050361 | A1 | 5/2002 | Shaw et al. | |
| 2007/0275585 | A1 | 11/2007 | Griffiths | |

* cited by examiner

*Primary Examiner* — William P Neuder
*Assistant Examiner* — Elizabeth Gitlin
(74) *Attorney, Agent, or Firm* — Steve Rosenblatt

(57) ABSTRACT

A tool is run into a liner that holds an electrical or hydraulic connection for a downhole tool which preferably is an electric submersible pump (ESP). It is capable of cleaning the electrical contacts, replacing them, isolating them from well fluid if no ESP or other downhole tool is to be present for a long time or switching from a main to a backup supply cable or hydraulic line among other downhole functions. The liner with the exterior cable or hydraulic line attached remains in position. Applications to other tools that obtain power or hydraulic pressure in a downhole wet connection are contemplated.

27 Claims, 9 Drawing Sheets

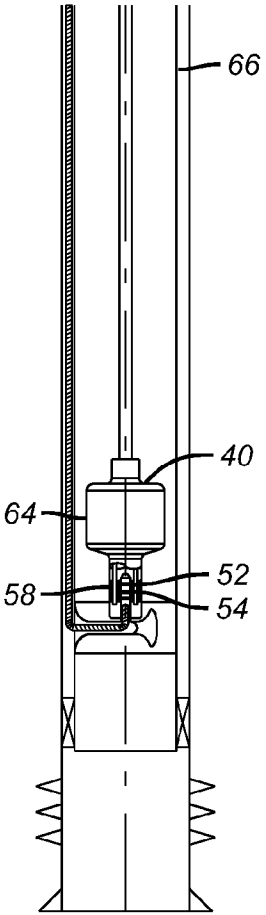
FIG. 5
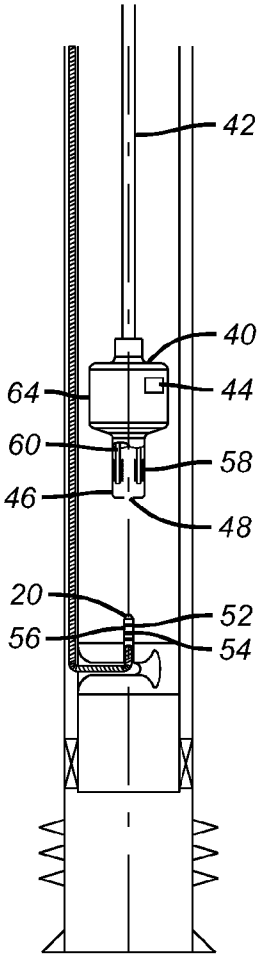
FIG. 4
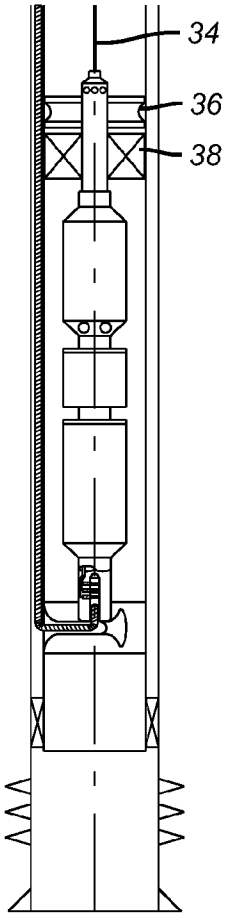
(PRIOR ART) FIG. 3
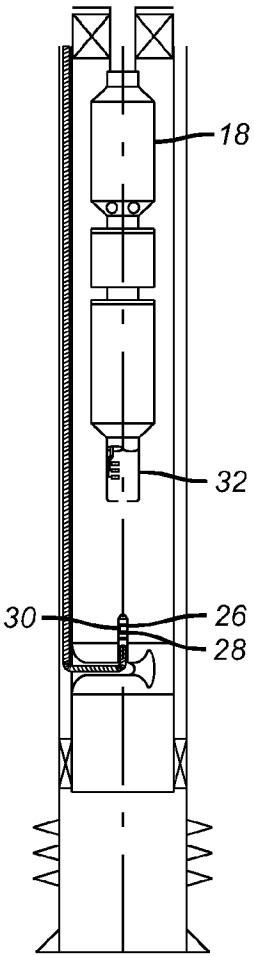
(PRIOR ART) FIG. 2
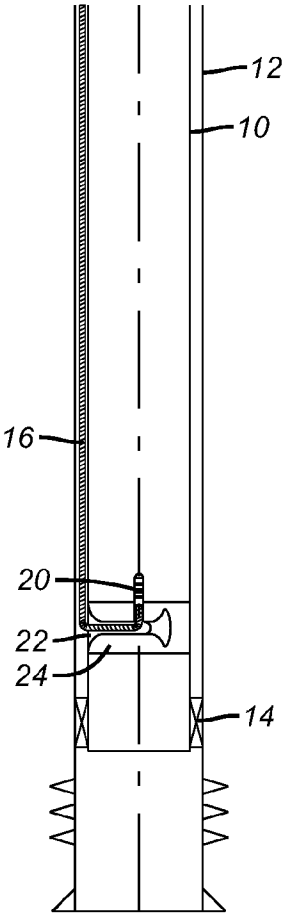
(PRIOR ART) FIG. 1

DOWNHOLE CONNECTOR MAINTENANCE TOOL

FIELD OF THE INVENTION

The field of this invention is maintenance and reconditioning of a downhole stab type electrical or hydraulic connectors and more particularly permanently installed connectors adapted for powering down hole equipment such as an electric submersible pump (ESP) including contact replacement or reconditioning or replacement of down hole hydraulic stab sealing surfaces or switching power cables or hydraulic lines as some examples of tool functionality.

BACKGROUND OF THE INVENTION

FIGS. 1-3 refer to the current state of the art. A liner 10 is installed in casing 12 with an optional packer 14. A cable or hydraulic line 16 runs outside the liner 10 and can carry power, communication or control lines for the operation of the ESP or down hole equipment 18 when it is mated to the electrical or hydraulic stab 20. The cable or hydraulic line 16 comes through an opening 22 in the liner 10 and into a shoe 24. The stab 20 can have spaced circumferential contacts such as 26 and 28 separated by an insulating band 30 in an alternating pattern to present as many contact locations as necessary for proper operation of the ESP. The ESP has a receptacle 32 that lands on the stab 20 with a complementary set of contacts to engage contacts 26 and 28 so that the ESP when fully landed has full functionality. There are many existing methods of aligning electrical contacts or hydraulic connections that may be used. The ESP 18 can be delivered on wireline or electric line 34 and carry a latch 36 to engage a profile (not shown) within the liner 10 for stabilization. A packer 38 can be set and the installation line 34 released and the ESP 18 can be operated to boost pressure of well fluids to get them to the surface in the familiar manner.

The state of the art in ESP connections downhole is reflected in the following U.S. patents and Publication Numbers: 2002/0050361 (see FIG. 8); U.S. Pat. Nos. 6,415,869; 4,589,492; 1,801,731; 4,997,384; 5,389,003; 6,154,953; 6,398,583; 7,291,028; 7,404,725; 7,462,051 and 2007/0275585.

What is need and is addressed by the present invention are options for maintenance downhole when the ESP is in position and there are issues with the connector that controls it. Pulling the liner with the power cable and the shoe that supports the stab 20 is an extreme and costly measure that is better off avoided. There are many potential connector issues that can develop that can be addressed without pulling the liner with a tool of the present invention. The electrical or other contacts can be remotely cleaned in place by a tool that is delivered to the stab 20. The tool can also grasp a connector and replace it. The tool can uncover surplus connectors that are temporarily covered to allow continued operation. The tool can protect what would otherwise be exposed connectors if there is no ESP to be installed for a long time on the stab 20. Another option for the tool is to switch cables where the liner is provided with a backup cable. The common theme to all these operations is that they are done remotely with a tool inserted through the liner that holds the shoe 24 with the stab 20 so that the liner 10 does not need to be removed. Those skilled in the art will better understand the invention from a review of the detailed description of the preferred embodiment and the associated drawings while recognizing that the full scope of the invention is determined by the appended claims.

SUMMARY OF THE INVENTION

A tool is run into a liner that holds an electrical or hydraulic connection for a downhole tool which preferably is an electric submersible pump (ESP). It is capable of cleaning the electrical contacts, replacing them, isolating them from well fluid if no ESP or other downhole tool is to be present for a long time or switching from a main to a backup supply cable or hydraulic line among other downhole functions. The ability to use the tool takes away the need to pull the liner with the exterior cable or hydraulic line attached. It further allows the ESP or another downhole tool to be put back in service faster. Applications to other tools that obtain power or hydraulic pressure in a downhole wet connection are contemplated.

BRIEF DESCRIPTION OF THE DRAWINGS

FIG. 1 is a prior art liner with a shoe supporting a male connector looking uphole;

FIG. 2 is the view of FIG. 1 showing an ESP assembly about to be landed on the connector;

FIG. 3 is the view of FIG. 2 with the ESP fully landed on the connector;

FIG. 4 shows the maintenance tool of the present invention coming close to a male connector in a shoe downhole;

FIG. 5 shows the tool of FIG. 4 fully landed on the male connector;

DETAILED DESCRIPTION OF THE PREFERRED EMBODIMENT

Figure 8:
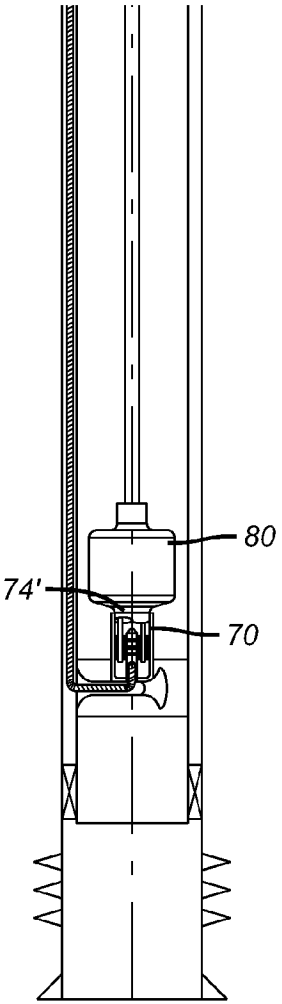
FIG. 8 is the view of FIG. 7 with the ESP removed and the maintenance tool repositioned to work on contacts or to reseal the enclosure until further use.
Figure 7:
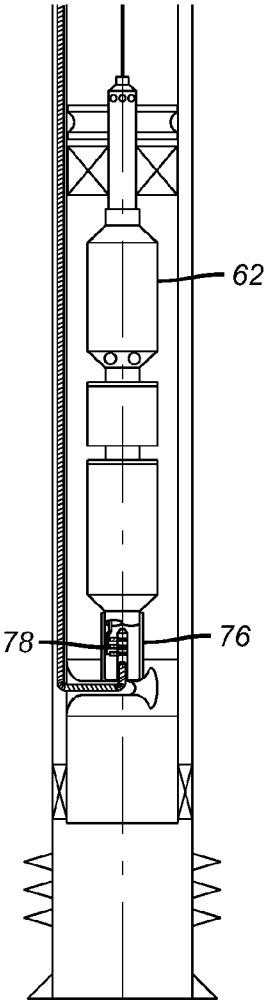
FIG. 7 is the view of FIG. 6 with the ESP penetrating the enclosure to make contact.

Looking at FIG. 4 the tool 40 can be delivered in a variety of ways generally shown as 42. Coiled tubing can be used or electric line. Slickline can be used with an onboard power supply schematically illustrated as 44. Rigid tubing can also be used as another option. Which option is used will depend on cost as determined by the available rig equipment on the surface. The tool 40 has a lower end housing 46 with a downhole oriented opening 48 designed to accept the male connector 50 that has spaced circumferential contacts 52 and 54 that are separated axially by a ring of an insulator 56. The tool 40 internal to the housing 46 features axially oriented brushes 58 on rotating shafts 60. The brush segments 58 can be spaced so that when the tool 40 is fully landed the segments of the brush 58 will align with the contacts such as 52 and 54 to polish them and to remove buildup that can or has interrupted contact with the ESP 62 shown in FIG. 7. Alternatively the brush material 58 can have an axial length to span all the contacts and the insulators between them when the tool 40 is fully landed as shown in FIG. 5. The shafts can be symmetrically distributed in the tool 40 and preferably even in number so that half turn one way and half the other way so that the tool 40 is not subjected to a net torque and will not tend to rotate about its longitudinal axis when all the brushes are turning. This alternative could be more useful if the tool 40 is run on rigid tubing. Alternatively, the tool body 64 can be rotatably mounted to the support 42 and driven to rotate on its own axis such as with onboard power supply 44 or a remote power feed that comes along the support 42. Alternatively, the cleaning tool may use a reciprocating motion with a shaped circumferential cleaning tool or a combination of reciprocating and rotating motion. A simple pair of contacting wheels or gears should develop enough power to spin the housing 64 on its axis as the brushes 58 are rotated on shafts 60. As another alternative, if all the shafts 60 are turning the same direction, a net force will develop that will walk the brushes 58 around the respective contacts that they are trying to clean. While the brushes 58 can be bristles made of fiber or metal other forms of mechanical or chemical cleaning are contemplated such as using spray jets to remove debris or chemicals that will not attack the contacts 52 and 54 but will dissolve or otherwise remove the debris that has accumulated on them are all contemplated to be a part of the invention.

FIG. 5 shows the tool 40 with the brushes 58 aligned with the contacts such as 52 and 54 for cleaning them. The contacts 52 and 54 can be configured to be removable and replaceable with the tool 40. For example the contacts 52 and 54 can be semi-circular with retainers that can be operated with the tool 40 with one set of rotating members that can release the fasteners while grasping the contact to radially retract it. A replacement contact can also be in position to be articulated into position to replace the contact just removed by repositioning the housing 64 a predetermined amount so that the replacement contact can be pushed in radially and secured with the same fasteners that held its predecessor. In this manner the tool 40 can replace one to all the contacts downhole without a need to remove the liner 66.

Figure 6:
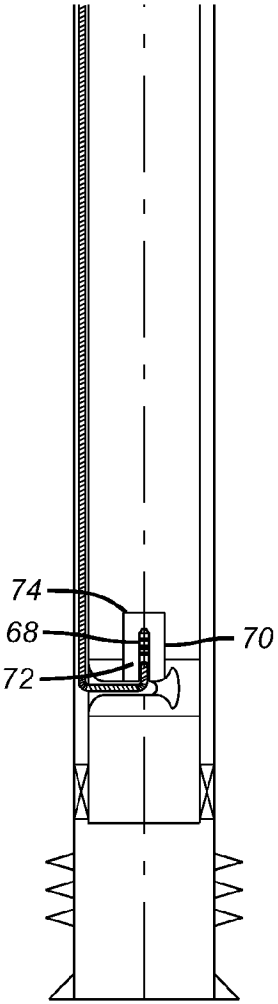
FIG. 6 shows an enclosure over the male connector to isolate it from well fluids until ready for use that can be penetrated to connect an ESP.

Referring to FIG. 6 the male connector 68 can be enclosed in a cylindrical housing 70 and filled internally with fluid 72 that will prevent well fluids from reaching the contacts on the connector 68 that is wholly within the housing 70. The housing 70 can have a removable cover 74 that can be penetrated or otherwise removed by the advancing female component cover 76 that carries the female connector 78 whose contacts will align with the contacts on the male connector when the FIG. 7 position is reached. Thus the initial mating of 78 and 68 is done in the presence of the fluid 72 after the cover is removed or otherwise gotten out of the way. After the ESP 62 is later removed it is desirable to protect the connector 68 if it will be a long time before another ESP will be lowered into position. The tool 80 be lowered in and deliver replacement fluid 72 and a cover 74' over it and fasten it to the housing 70.

Figure 10:
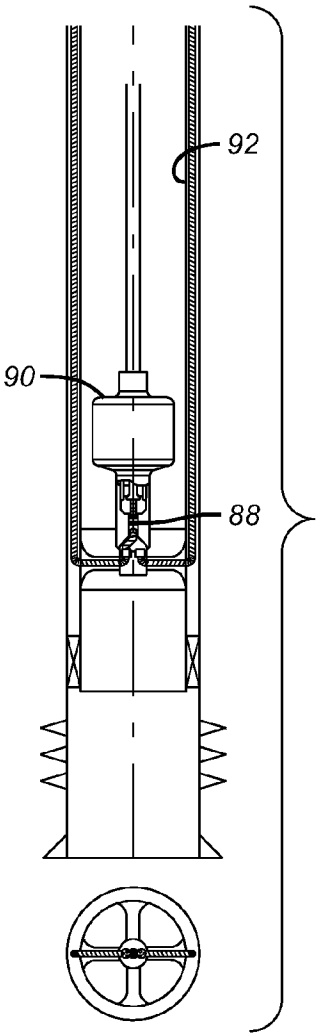
FIG. 10 is the view of FIG. 9 with the maintenance tool landed in position to switch cable feeds.
Figure 9:
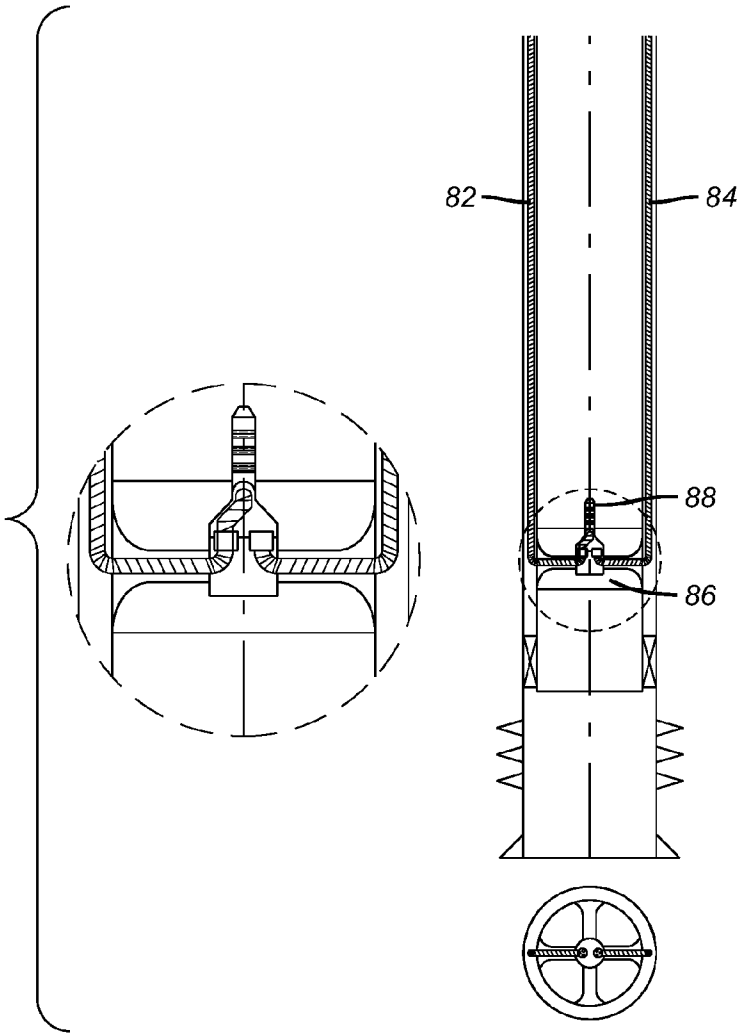
FIG. 9 shows a liner with multiple cables to feed the contacts in the male connector with the cable on the left initially connected.
Figures 11A, 11B, 11C, 11D:
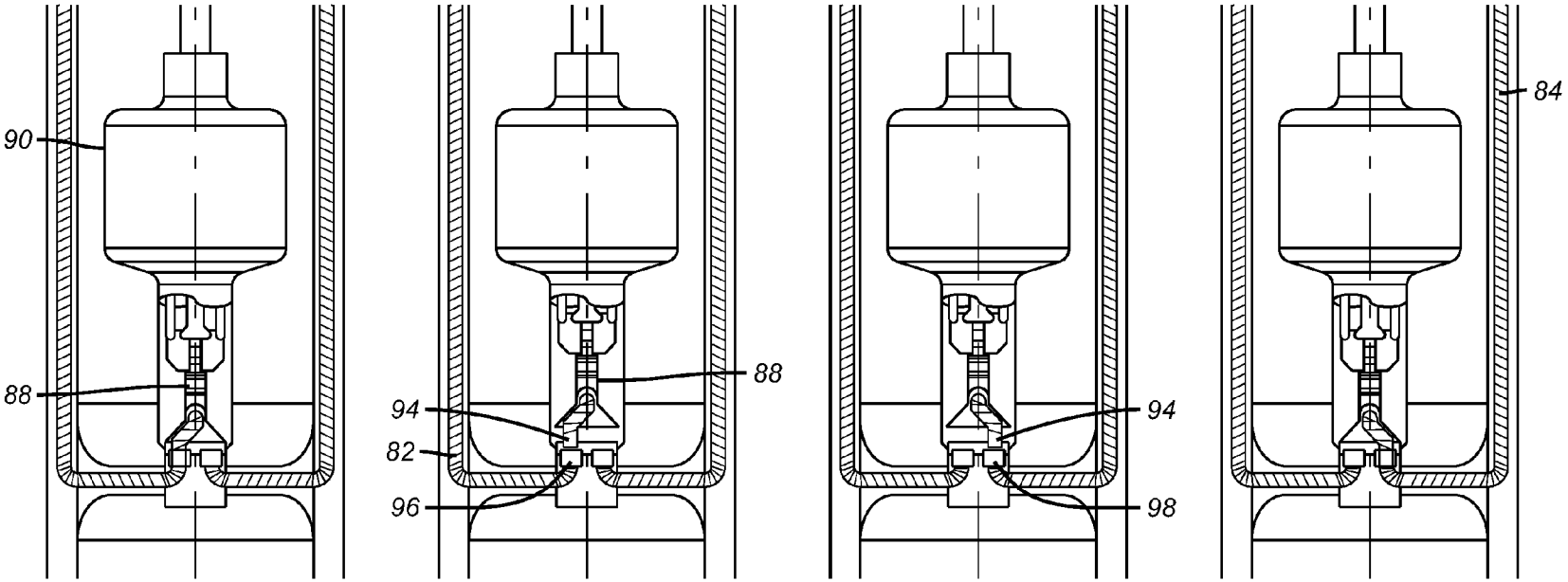
FIGS. 11*a*-11*d* show the sequence where the tool switches connection from one cable to another.

FIG. 9 shows two cables 82 and 84 going into the shoe 86 with 82 being connected to the male connector 88. If cable 82 stops working for any reason it is possible to use tool 90 to reconfigure connector 88 to be connected to cable 84 instead of cable 82 so that there is no need to pull the liner 92. FIGS. 10 and 11*a* show the tool 90 landed on the male connector 88. FIG. 11*b* shows the male connector 88 lifted enough to remove the connecting prong 94 from its receptacle 96 that had allowed cable 82 to be connected to it. In FIG. 11*c* the male connector 88 is rotated on its axis to now align prong 94 with receptacle 98. In FIG. 11*d* the male connector 88 has been lowered to get prong 94 into receptacle 98. There are alternative ways to do this such as simply rotating the male connector 88 and using flush connectors instead of prong and socket devices that require a pickup force. The connector 88 can have a sealingly and rotatably mounted base that can alternatively make contact with either cable below the base with flush contacts that are sealed off from well fluids. Although alternating between two cables is illustrated, it is also possible to have more than two cables for services where interruptions need to be kept to a minimum.

The downhole remote operated tool 100 in this operation has multiple tool heads for example 102, 104, 106 and 108 in several tool locations. Preferably, each tool head has the necessary motors and rams to perform its individual function. Preferably, the motors or rams would be hydraulic but other motivating forces such as electric motors and solenoids are possible as well. There is also an operating ram 110 that can move from storage locations to pick up the tool head required for the particular operation it is required to do. Only 4 tool heads are shown in FIG. 12 but there may be more as required for the planned operation.

Figure 12:
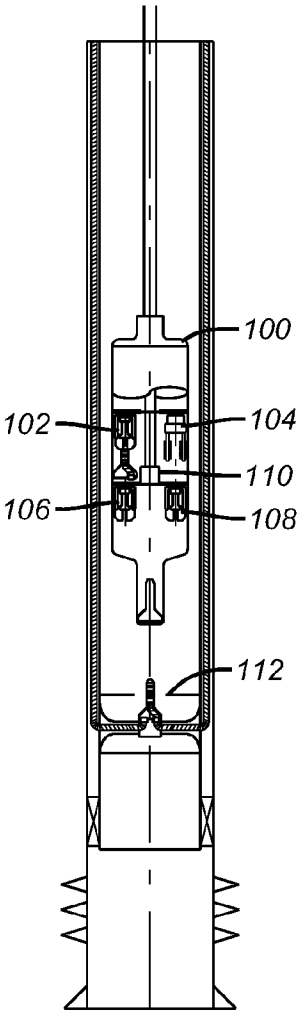
FIG. 12 shows a remote multi-function tool run in toward an existing shoe.

FIG. 12 shows the tool 100 loaded with an two empty gripper tools 106 and 108, one gripper tool with a new set of contacts 102, and a contact cleaner tool 104 being lowered in the well.

Figure 13:
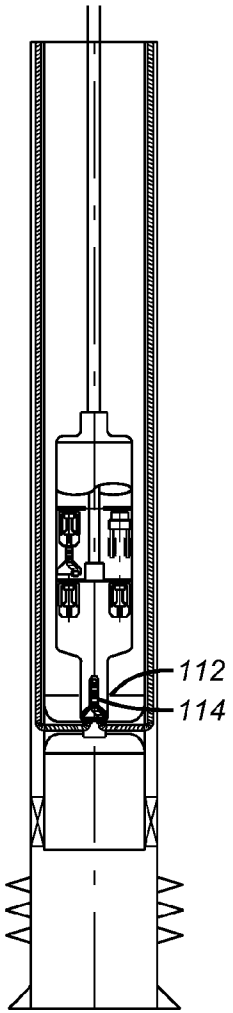
FIG. 13 is the view of FIG. 2 with the tool landed on the shoe.

FIG. 13 shows the tool 100 landed on the ESP seating shoe 112, and sealed to the seating shoe. The tool 100 has a sealing cap 114 installed on its bottom face to prevent well fluid contamination of the inside of the tool 100. There can be well fluid trapped between the cap 114 and the seating shoe 112 that can be eliminated using several methods. The nose of the tool 100 can be covered with an expendable rubber gasket (not shown) and the cap 114 filled with a clean fluid or gel. The gasket would wipe the seating shoe contacts and surfaces while the gel would be expelled out of the cavity of the cap 114 and seating shoe 112 removing the contaminating well fluid. The tool 100 would then seal against the seating shoe 112.

Figure 14:
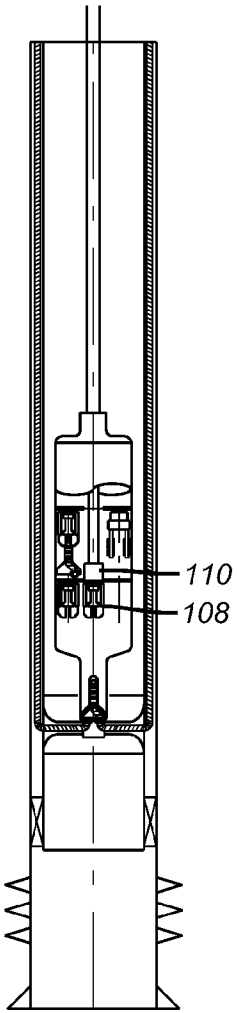
FIG. 14 is the view of FIG. 13 with a first operating head moved into position over the shoe.

In FIG. 14 an empty gripper tool head 108 is moved from its storage location to under the operating ram 110. Necessary hydraulic or electrical connections are made between the gripper 108 and ram 110. The forces and motions to move the tool 108 from the storage location may be included in the ram 110 or in the storage location.

Figure 15:
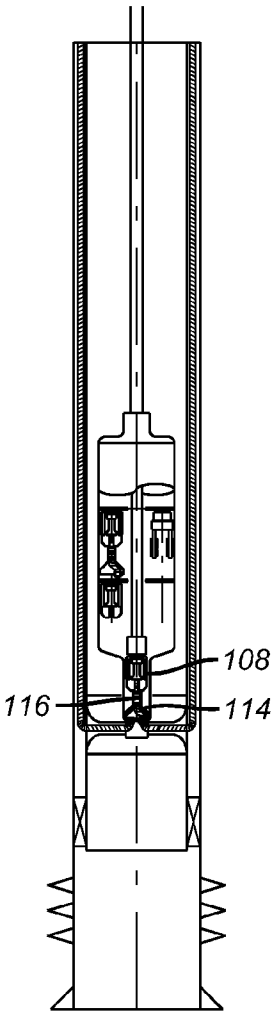
FIG. 15 is the view of FIG. 14 shows the operating head gripping the sealing cap on the shoe for eventual removal.

FIG. 15 shows the empty gripper tool head 108 moved down to the operating position. It will grip the sealing cap 114 and apply the correct forces and or motions to remove the sealing cap 114 and expose the old set of contacts 116 that are in the well.

Figure 19:
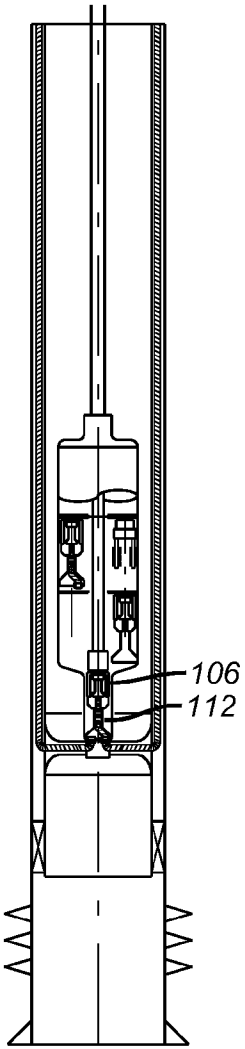
FIG. 19 is the view of FIG. 18 shows the contact gripped prior to removal.
Figure 18:
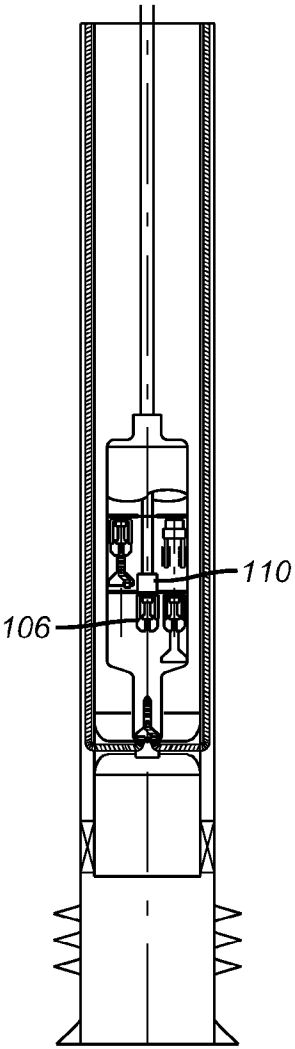
FIG. 18 is the view of FIG. 17 shows a contact removal head moved into position above the contact to be removed.
Figure 17:
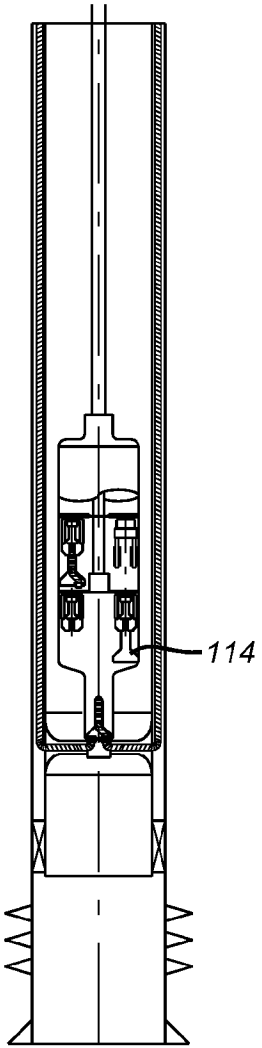
FIG. 17 is the view of FIG. 16 with the sealing cap shifted to the side in the tool to permit further operations.
Figure 16:
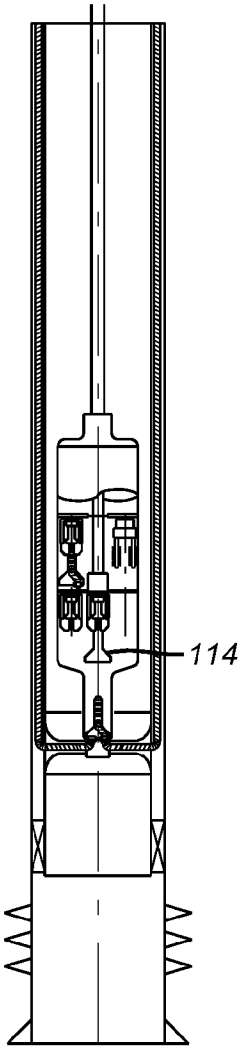
FIG. 16 is the view of FIG. 15 showing the cap removed from the shoe.

FIG. 16 shows the gripper head 108 with the sealing cap 114 moved up. FIG. 17 shows the gripper head 108 with the sealing cap 114 moved laterally. FIG. 18 shows the empty gripper head 106 moved into position below the operating ram 110. FIG. 19 shows the empty gripper head 106 moved down to the operating position. It will grip the old contact set 112 and apply the appropriate forces and motions to release the old contact set 112 from the seating shoe. Not shown is that the contacts may require a flushing operation while they are released to prevent hydraulic lock or to eliminate contaminated fluids in the contact receptacle area. A port may be provided down the length of the contact that could be opened by the gripper head 106 and the appropriate fluid flushed into the receptacle area while the contacts 112 are removed.

Figure 23:
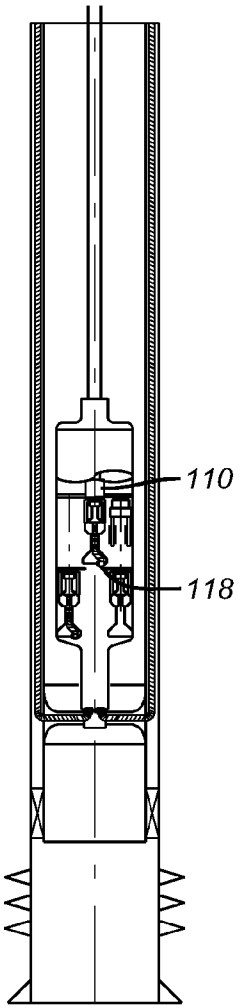
FIG. 23 is the view of FIG. 22 showing an operating head with new contacts shifted into position to be operated by the operating head.
Figure 22:
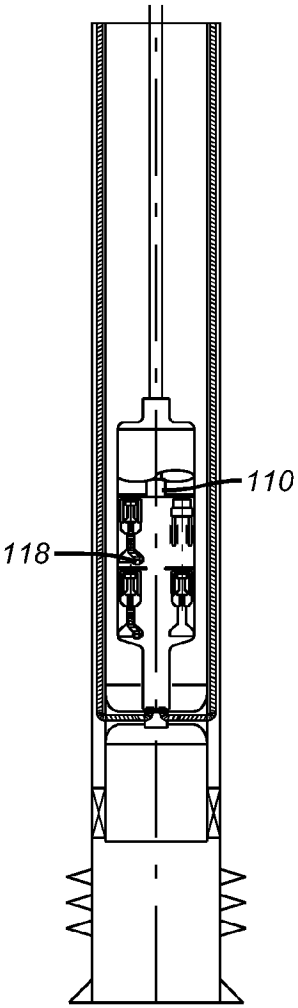
FIG. 22 is the view of FIG. 21 showing the operating ram lifted to access other operating heads.
Figure 21:
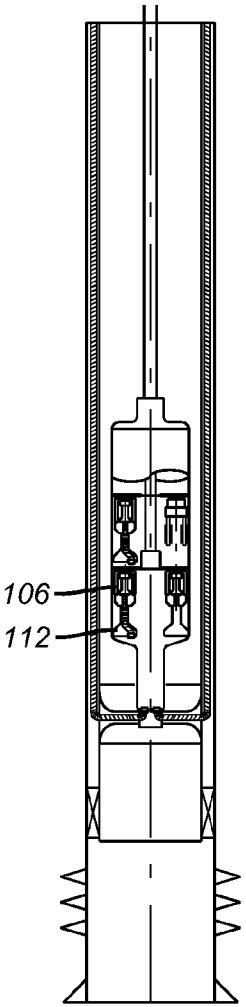
FIG. 21 is the view of FIG. 20 showing the old contact shifted laterally out of the way to facilitate the next operation.
Figure 20:
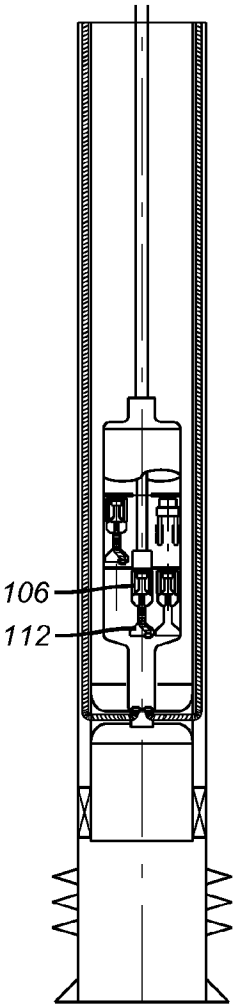
FIG. 20 is the view of FIG. 19 showing the old contact removed and lifted.

FIG. 20 shows the gripper head 106 with the old contacts 112 moved up. FIG. 21 shows the old contacts 112 and gripper head 106 moved laterally. In FIG. 22 the ram 110 moves up above new contacts 118 and in FIG. 23, the new contacts 118 in a gripper head 102 are moved to below the operating ram 110.

Figure 24:
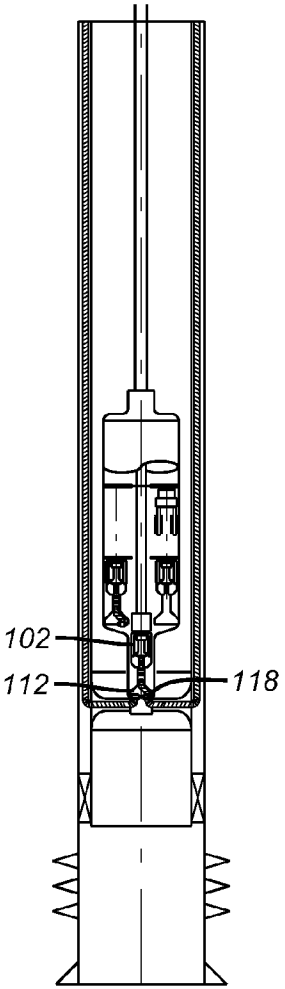
FIG. 24 is the view of FIG. 23 showing the new contact brought down into position on the shoe.

FIG. 24 shows the new contacts 118 being moved down to the seating shoe 112. The gripper head 102 would apply the appropriate forces and motions to the contacts 118 to install them into the seating shoe 112. If flushing and sealing the contacts is required, that function could be designed into the gripper head tool 100 or it may be in a separate tool that would be used after the gripper head installs the new contacts 118. Likewise, the opening and flushing operations on the old contact set may be accomplished by a separate tool that is used before the gripper head 106 removes the old contacts 116.

Figure 26:
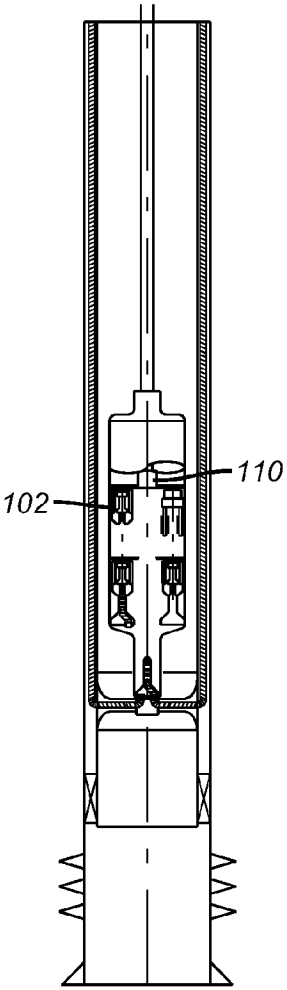
FIG. 26 is the view of FIG. 25 showing the operating head for the new contact that is now empty moved laterally to facilitate subsequent operations.
Figure 25:
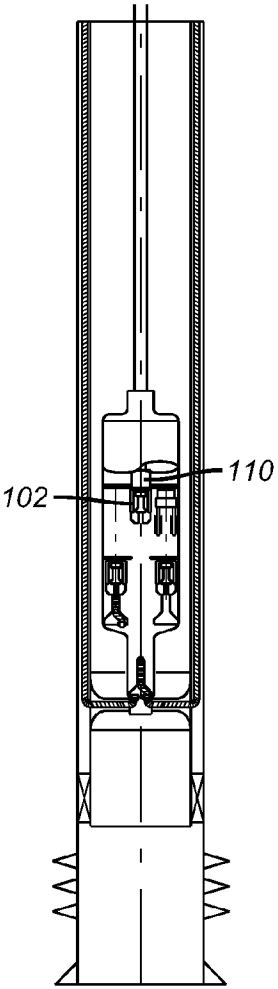
FIG. 25 is the view of FIG. 24 showing the operating head retracted after installing the new contact.

FIG. 25 shows the shows the empty gripper head 102 being moved up while FIG. 26 shows the empty gripper 102 moved laterally into a storage position.

Figure 27:
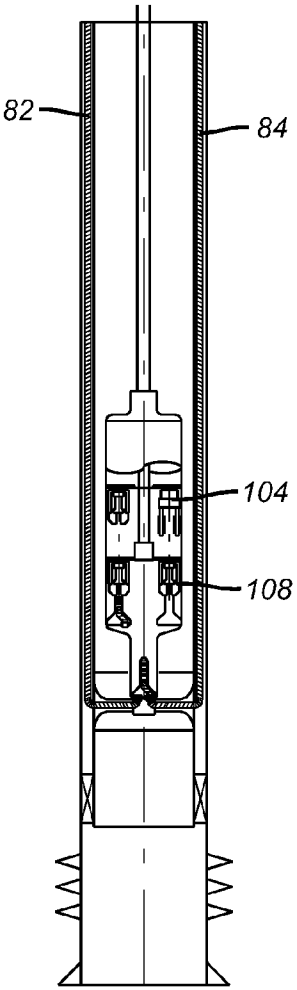
FIG. 27 is the view of FIG. 26 with the operating ram lowered in preparation for reinstalling a protective cover on the newly installed contact.

Other operations may be performed at this time with tool heads designed for this purpose. The contact cleaning tool 104 shown in FIG. 27 could be used to clean the contacts before the tool is retracted. Also, it would be desirable to be able to check continuity of all the cable lines 82, 84 from the surface. A special tool head (not shown) can be moved down to the newly installed contacts 118 and to short them out and allow the cable continuity to be measured from the surface. The cable insulation resistance could be measured at the same time. If the readings are low some troubleshooting or remedial operations may be completed such as cleaning and flushing the contacts. The contacts could be changed from one cable 82 to another 84 using a gripper head.

Figure 32:
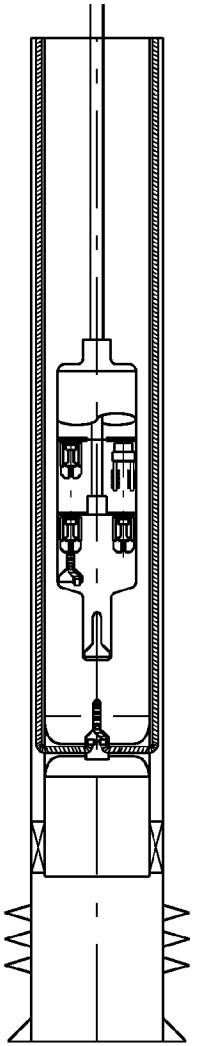
FIG. 32 is the view of FIG. 31 shows the remote multipurpose tool being removed from the downhole shoe.
Figure 31:
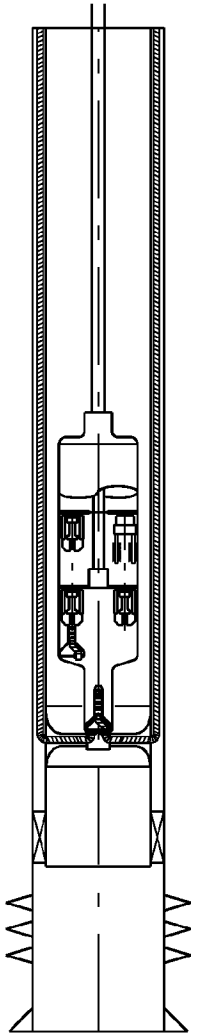
FIG. 31 is the view of FIG. 30 shows the operating head for the sealing cap moved laterally out of the way for subsequent operations.
Figure 30:
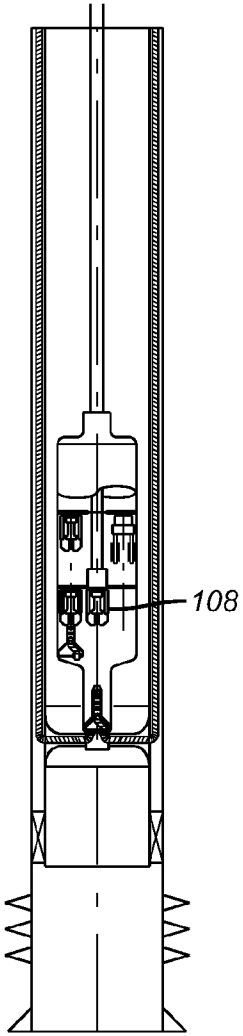
FIG. 30 is the view of FIG. 29 shows the operating head that delivered the sealing cap now retracted up.
Figure 29:
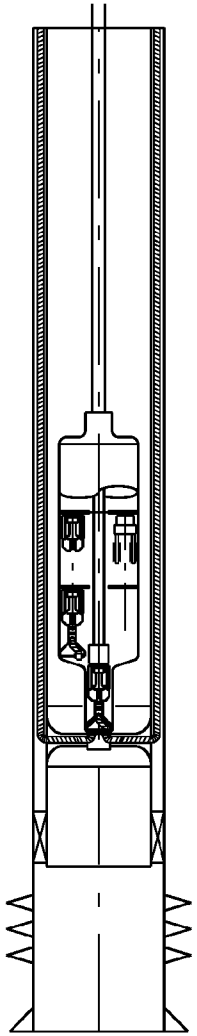
FIG. 29 is the view of FIG. 28 showing the sealing cap installed onto the new contact.
Figure 28:
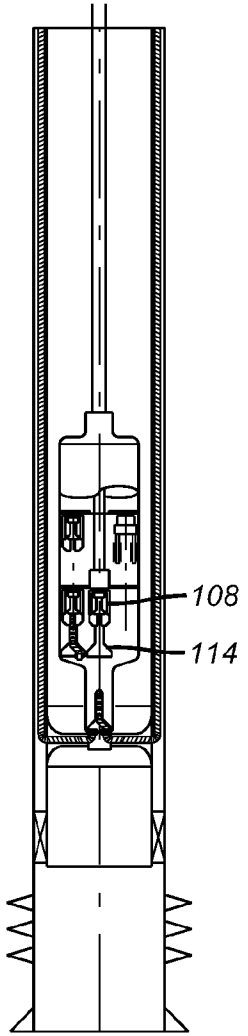
FIG. 28 is the view of FIG. 27 showing the sealing cap brought into alignment with the newly installed contact.

The gripper tool 108 and the sealing cap 114 are moved to the operating ram 110 in FIG. 28. FIG. 29 shows the operating ram 110 and moved down to the operating position. The gripper 108 will use the appropriate forces and motions to reinstall and seal the sealing cap 114. The down hole remote operated tool may be unseated from the seating shoe 112 at this time to using the flushing capability of the gripper tool 100 or a separate tool to equalize the pressure in between the remote operated tool 100 and the seating shoe 112 and prevent a hydraulic lock between the remote operated tool 100 and the seating shoe 112. The empty gripper 108 is shown being moved up in FIG. 30. The empty gripper 108 is moved laterally in FIG. 31 and the remote operated tool 100 is being removed from the well in FIG. 32.

There are many functions that could be accomplish with a remote operated tool in an oil well such as inspecting, cleaning or replacing permanent instrumentation, or even gas lift mandrels.

Of course the remote operated tool would be properly instrumented to allow the remote operated tool to be properly controlled by its operator. Temperatures, pressures, voltage, current, vibration and other parameters would be monitored as required as well as appropriate video cameras used to allow the operator to see the operation of the remote operated tool. Of course, appropriate flushing means would be used to keep clear fluid between the video cameras and the area that is being observed.

The tool head magazine shown has stationary tool head storage locations and a moving ram and operating head. The storage locations may be moved as on a carousel or by a chain drive system or a guided path where the tools heads and storage locations are moved by shoving on the tool heads, or the storage locations or on both, and the operating head may be stationary. Alternatively a combination of movable storage locations and a movable operating head may be used.

While the preferred applications for servicing wet connections downhole with a variety of tools that avoid removal of the portion of the connection mounted downhole has been in operating ESP, those skilled in the art should understand that other types of downhole tools that require operation or control from the surface can also be used with the assortment of downhole service tools that in the preferred embodiment have covered functions such as contact cleaning or replacement, contact isolation from well fluids such as for periods of extensive downtime, or switching cable feeds to the downhole mounted connection without pulling it out of the hole.

The above description is illustrative of the preferred embodiment and many modifications may be made by those skilled in the art without departing from the invention whose scope is to be determined from the literal and equivalent scope of the claims below.

I claim:

1. A service tool assembly and a downhole tool for a downhole mounted component of a wet connection, comprising:

a downhole mounted connection component having at least one first contact;

a downhole tool having a mating component further comprising a least a second contact for engagement with said first contact for powering or controlling the operation of the downhole tool;

a service tool further comprising a housing supporting a service component which engages the connection component, when said mating component of said downhole tool is not engaged to said connection component, for the performance of at least one service thereon without removal of said mounted connection component from downhole.

2. The assembly and downhole tool of claim 1, wherein:

said service component cleans said first contact.

3. The assembly and downhole tool of claim 2, wherein:

said service component mechanically cleans said contact.

4. The assembly and downhole tool of claim 3, wherein:

said service component cleans using shaped cleaning tools moving in a reciprocating motion.

5. The assembly and downhole tool of claim 3, wherein:

said service component cleans using shaped cleaning tools moving in a reciprocating and rotating motion.

6. The assembly and downhole tool of claim 2, wherein:

said downhole tool comprises an electric submersible pump and said service tool is delivered to said downhole mounted connection on one of coiled tubing, rigid tubing, wire line and slickline.

7. The assembly and downhole tool of claim 1, wherein:

said service component isolates said first contact from well fluids downhole.

8. The assembly and downhole tool claim 7, wherein:

said downhole mounted connection comprises a surrounding housing covered by a removable cover to isolate said surrounded downhole mounted connection in a fluid;

said housing features a removable cover taken off by said mating component to allows said second contact to engage said first contact in said fluid.

9. The assembly and downhole tool of claim 8, wherein:

said service component, when delivered after removal of said mating component, comprises a replacement cover that it secures to said surrounding housing.

10. The assembly and downhole tool of claim 9, wherein:

said service component delivers replacement fluid into said surrounding housing before securing said replacement cover.

11. The assembly and downhole tool of claim 7, wherein:

said downhole tool comprises an electric submersible pump and said service tool is delivered to said downhole mounted connection on one of coiled tubing, rigid tubing, wire line and slickline.

12. The assembly and downhole tool of claim 1, wherein:

said service tool performs a plurality of services on said connection component in a single trip of said service tool downhole.

13. The assembly and downhole tool of claim 12, wherein:

said service tool remains connected to said connection component as said services are being performed.

14. The assembly and downhole tool of claim 13, wherein:

said service comprise at least two of removing a sealing cover from a contact, removing the contact, replacing the removed contact, cleaning a contact, replacing a sealing cover on the replacement contact, testing the new contact, shifting between power cables to the contact or shifting hydraulic lines.

15. The assembly and downhole tool of claim 1, wherein:

said contacts comprise electrical contacts.

16. The assembly and downhole tool of claim 1, wherein:

said contacts comprise hydraulic contacts.

17. A service tool assembly for a downhole mounted component of a wet connection, comprising:

a downhole mounted connection component having at least one first contact capable of receiving a mating component downhole associated with a downhole tool and having a least a second contact for engagement with said first contact for powering or controlling the operation of a downhole tool;

a service tool further comprising a housing supporting a service component which engages the connection component for the performance of at least one service thereon without removal of said mounted connection component from downhole;

said service component removes and replaces said first contact.

18. The assembly of claim 17, wherein:

said first contact is held by at least one releasable fastener;

said service component carries a replacement first contact and a release tool that selectively releases or secures said fastener;

said release tool releases said fastener to remove said first contact and said service component articulates said replacement first contact in its place and secures it with said fastener.

19. The assembly of claim 17, wherein:

said downhole tool comprises an electric submersible pump and said service tool is delivered to said downhole mounted connection on one of coiled tubing, rigid tubing, wire line and slickline.

20. A service tool assembly for a downhole mounted component of a wet connection, comprising:

a downhole mounted connection component having at least one first contact capable of receiving a mating component downhole associated with a downhole tool and having a least a second contact for engagement with said first contact for powering or controlling the operation of a downhole tool;

a service tool further comprising a housing supporting a service component which engages the connection component for the performance of at least one service thereon without removal of said mounted connection component from downhole;

said service component changes a cable connected to said contact.

21. The assembly of claim 20, wherein:

said downhole mounted connection is mounted to a tubular string supported downhole and further comprising a plurality of electrical cables or hydraulic lines supported by said string which can be placed in selective contact with said downhole mounted connection.

22. The assembly of claim 21, wherein:

said service component engaging said downhole mounted connection and turning it on its axis to selectively switch the cable or line connected to it.

23. The assembly of claim 22, wherein:

said service component lifts said downhole mounted connection to break a connection with one cable or line before rotating said downhole mounted connection and setting it down to connect to another cable or line.

24. The assembly of claim 23, wherein:

each said cable or line provides power or pressure to said downhole tool that further comprises an electrical submersible pump.

25. A service tool assembly for a downhole mounted component of a wet connection, comprising:

a downhole mounted connection component having at least one first contact capable of receiving a mating component downhole associated with a downhole tool and having a least a second contact for engagement with said first contact for powering or controlling the operation of a downhole tool;

a service tool further comprising a housing supporting a service component which engages the connection component for the performance of at least one service thereon without removal of said mounted connection component from downhole;

said service component cleans said first contact;

said service component mechanically cleans said contact;

said service component comprises a plurality of axially extending brushes on shafts that rotate on their axes to clean said contact.

26. The assembly of claim 25, wherein:

said shafts rotate in opposed directions to offset torque applied to said housing from brush rotation.

27. The assembly of claim 25, wherein:

said shafts rotate in the same direction to apply a torque to said housing to advance said brushes around said downhole mounted connection.

* * * * *